US005752625A

United States Patent [19]

Stucki

[11] Patent Number: 5,752,625

[45] Date of Patent: May 19, 1998

[54] VISCOUS FLUID DISPENSING SYSTEM

[76] Inventor: ElRoy L. Stucki, 597 N. 300 West, Beaver, Utah 84713

[21] Appl. No.: 767,216

[22] Filed: Dec. 16, 1996

[51] Int. Cl.[6] ..... B67D 5/00

[52] U.S. Cl. ..... 222/82; 222/209; 222/325; 222/401

[58] Field of Search ..... 222/82, 83, 325, 222/401, 209, 382, 383.1, 321.7, 321.9

[56] References Cited

U.S. PATENT DOCUMENTS 2,753,080 7/1956 Bartlett ..... 222/82
4,121,736 10/1978 McGaw, Jr. ..... 222/401
5,335,824 8/1994 Weinstein ..... 222/82

*Primary Examiner*—Philippe Derakshani

[57] ABSTRACT

A new Viscous Fluid Dispensing System for providing a convenient no-mess method of dispensing viscous fluids. The inventive device includes a cylindrical container, a pump within a side wall of the cylindrical container, a threaded lid removably enclosing the container, a threaded spout secured to the lid, and a fluid container removably positioned within the container. The pump pressurizes the interior of the fluid container which is punctured on the bottom by a blade. The viscous fluid flows through the puncture into a center tube then through the threaded spout with a cap pivotally attached to prevent drying of the viscous fluid.

8 Claims, 3 Drawing Sheets

VISCOUS FLUID DISPENSING SYSTEM

BACKGROUND OF THE INVENTION

1. Field of the Invention

The present invention relates to Dispensing Devices and more particularly pertains to a new Viscous Fluid Dispensing System for providing a convenient no-mess method of dispensing viscous fluids.

2. Description of the Prior Art

The use of Dispensing Devices is known in the prior art. More specifically, Dispensing Devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art Dispensing Devices include U.S. Pat. No. 4,809,878; U.S. Pat. No. 4,854,484; U.S. Design Patent 272,797; U.S. Pat. No. 5,016,780; U.S. Pat. No. 5,295,274 and U.S. Pat. No. 4,694,977.

While these devices fulfill their respective, particular objectives and requirements, the aforementioned patents do not disclose a new Viscous Fluid Dispensing System. The inventive device includes a cylindrical container, a pump within a side wall of the cylindrical container, a threaded lid removably enclosing the container, a threaded spout secured to the lid, and a fluid container removably positioned within the container.

In these respects, the Viscous Fluid Dispensing System according to the present invention substantially departs from the conventional concepts and designs of the prior art, and in so doing provides an apparatus primarily developed for the purpose of providing a convenient no-mess method of dispensing viscous fluids.

SUMMARY OF THE INVENTION

In view of the foregoing disadvantages inherent in the known types of Dispensing Devices now present in the prior art, the present invention provides a new Viscous Fluid Dispensing System construction wherein the same can be utilized for providing a convenient no-mess method of dispensing viscous fluids.

The general purpose of the present invention, which will be described subsequently in greater detail, is to provide a new Viscous Fluid Dispensing System apparatus and method which has many of the advantages of the Dispensing Devices mentioned heretofore and many novel features that result in a new Viscous Fluid Dispensing System which is not anticipated, rendered obvious, suggested, or even implied by any of the prior art Dispensing Devices, either alone or in any combination thereof.

To attain this, the present invention generally comprises a cylindrical container, a pump within a side wall of the cylindrical container, a threaded lid removably enclosing the container, a threaded spout secured to the lid, and a fluid container removably positioned within the container.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Viscous Fluid Dispensing System apparatus and method which has many of the advantages of the Dispensing Devices mentioned heretofore and many novel features that result in a new Viscous Fluid Dispensing System which is not anticipated, rendered obvious, suggested, or even implied by any of the prior art Dispensing Devices, either alone or in any combination thereof.

It is another object of the present invention to provide a new Viscous Fluid Dispensing System which may be easily and efficiently manufactured and marketed.

It is a further object of the present invention to provide a new Viscous Fluid Dispensing System which is of a durable and reliable construction.

An even further object of the present invention is to provide a new Viscous Fluid Dispensing System which is susceptible of a low cost of manufacture with regard to both materials and labor, and which accordingly is then susceptible of low prices of sale to the consuming public, thereby making such Viscous Fluid Dispensing System economically available to the buying public.

Still yet another object of the present invention is to provide a new Viscous Fluid Dispensing System which provides in the apparatuses and methods of the prior art some of the advantages thereof, while simultaneously overcoming some of the disadvantages normally associated therewith.

Still another object of the present invention is to provide a new Viscous Fluid Dispensing System for providing a convenient no-mess method of dispensing viscous fluids.

Yet another object of the present invention is to provide a new Viscous Fluid Dispensing System which includes a cylindrical container, a pump within a side wall of the cylindrical container, a threaded lid removably enclosing the container, a threaded spout secured to the lid, and a fluid container removably positioned within the container.

Still yet another object of the present invention is to provide a new Viscous Fluid Dispensing System that makes the use of viscous fluids, such as honey, more convenient in the home.

Even still another object of the present invention is to provide a new Viscous Fluid Dispensing System that prevents the viscous fluid from drying out from exposure to the air.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
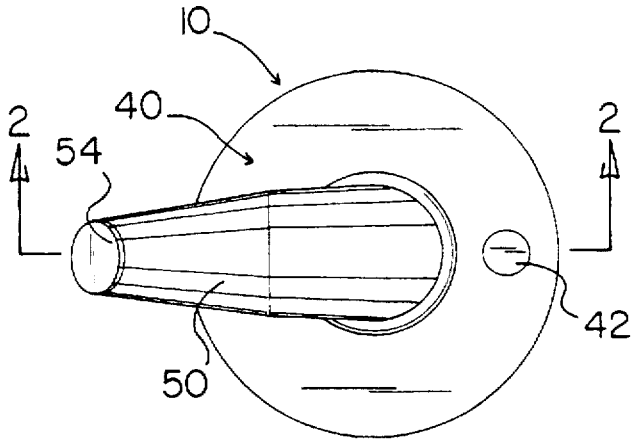
FIG. 1 is a top view of a new Viscous Fluid Dispensing System according to the present invention.

With reference now to the drawings, and in particular to FIGS. 1 through 6 thereof, a new Viscous Fluid Dispensing System embodying the principles and concepts of the present invention and generally designated by the reference numeral 10 will be described.

More specifically, it will be noted that the Viscous Fluid Dispensing System 10 comprises a cylindrical container 20, a pump within a side wall of the cylindrical container 20, a threaded lid 40 removably enclosing the container, a threaded spout 50 secured to the lid, and a fluid container 60 removably positioned within the container.

Figure 2:
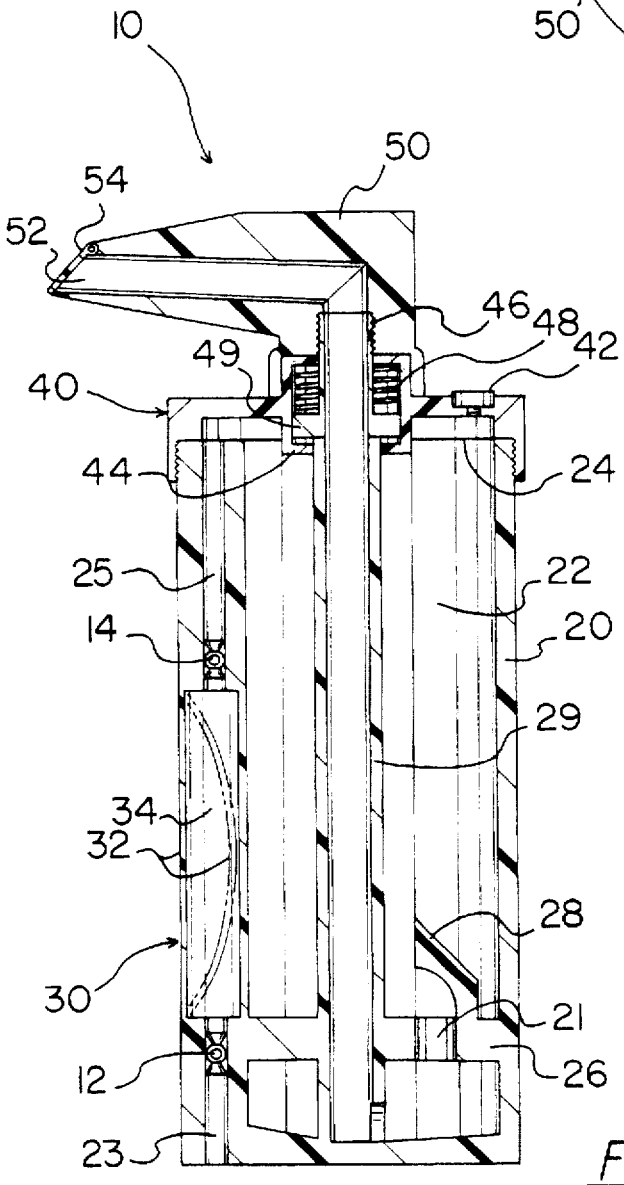
FIG. 2 is a cross sectional view taken along line 2—2 of FIG. 1.
Figure 3:
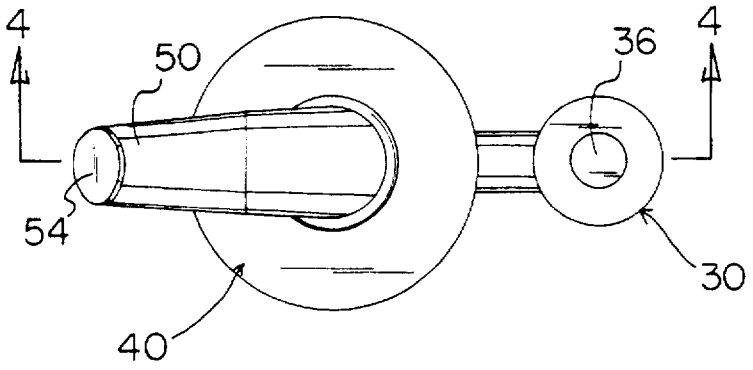
FIG. 3 is a top view of an alternative embodiment disclosing the hand pump.
Figure 4:
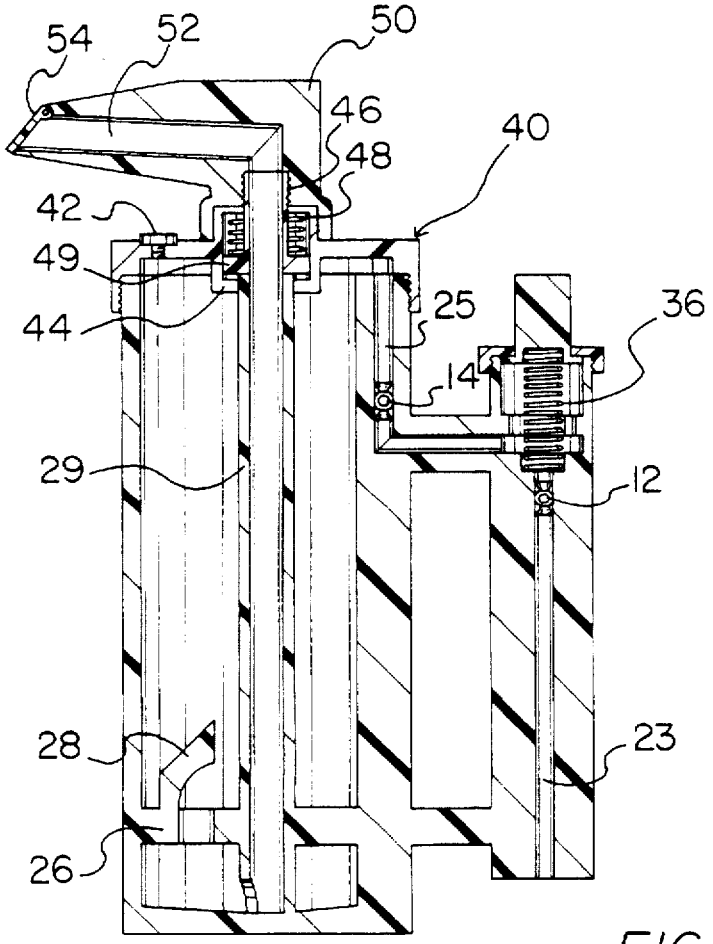
FIG. 4 is a cross sectional view taken along line 4—4 of FIG. 3.

As best illustrated in FIGS. 2 and 4, it can be shown that the cylindrical container 20 has a lumen 22. A base 26 is secured to an end of the cylindrical container 20 opposite of an open end 24 of the cylindrical container 20. A center tube 29 is coaxially projecting through the lumen 22 to engage the base 26 coaxially as best shown in FIGS. 2 and 4. The end of the center tube 29 opposite of the base 26 is flush with the open end 24. A first passage 21 projects from the lumen 22 through the base 26 and fluidly is connected to the center tube 29. A threaded lid 40 is threadably engaged to the open end 24. An interior flange 44 projects downwardly from said threaded lid 40 to surround coaxially the center tube 29 opposite of the base 26. A flanged end tube 49 is slidably positioned mesial interior flange 44 and the threaded neck 46. The flanged end tube 49 is rotatable with respect to the center tube 29. The flanged end tube 44 has a threaded neck 46 as best shown in FIGS. 2 and 4 of the drawings. The threaded neck 46 extends past the threaded lid 40 a finite distance as best shown in FIG. 2 of the drawings, for threadably engaging a threaded spout 50. A compression spring 48 is compressed mesial the flanged end tube 49 and the threaded neck 46. As shown in FIGS. 1 through 4, the threaded spout 50 is threadably secured to the threaded neck 46 and is connected with the flanged end tube 49 for dispensing a viscous fluid from within the lumen 22. A blade 28 is preferably secured to the base 26 within the lumen 22 extending upwardly as shown in FIGS. 2 and 4. As shown in FIGS. 1 through 4, the threaded spout 50 has a cap 54 pivotally attached for enclosing an exit passage 52 connected to the flanged end tube 49. The cap 54 is for preventing the viscous fluid from drying out during non-use of the present invention. As shown in FIGS. 1 through 4, a pressure relief valve 42 is positioned within the threaded lid 40 to prevent pressure from increasing to high.

Figure 5:
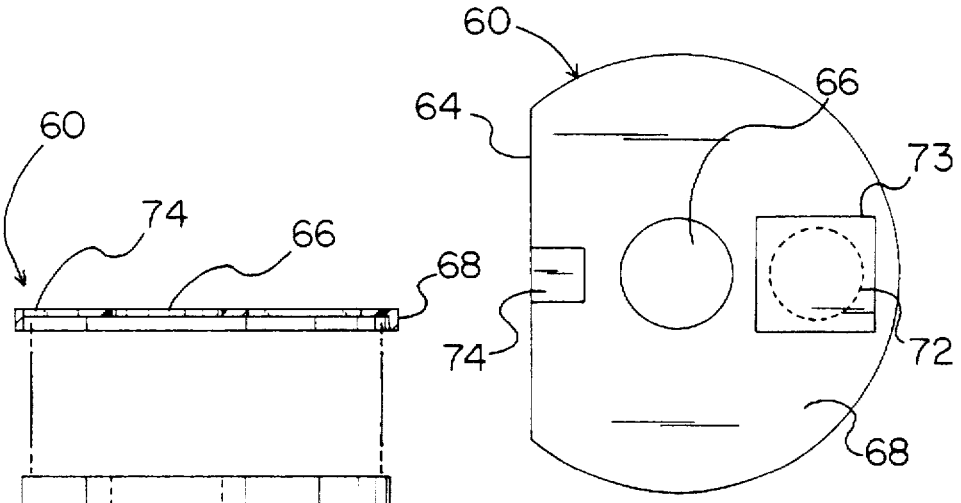
FIG. 5 is a top view of the fluid container.
Figure 6:
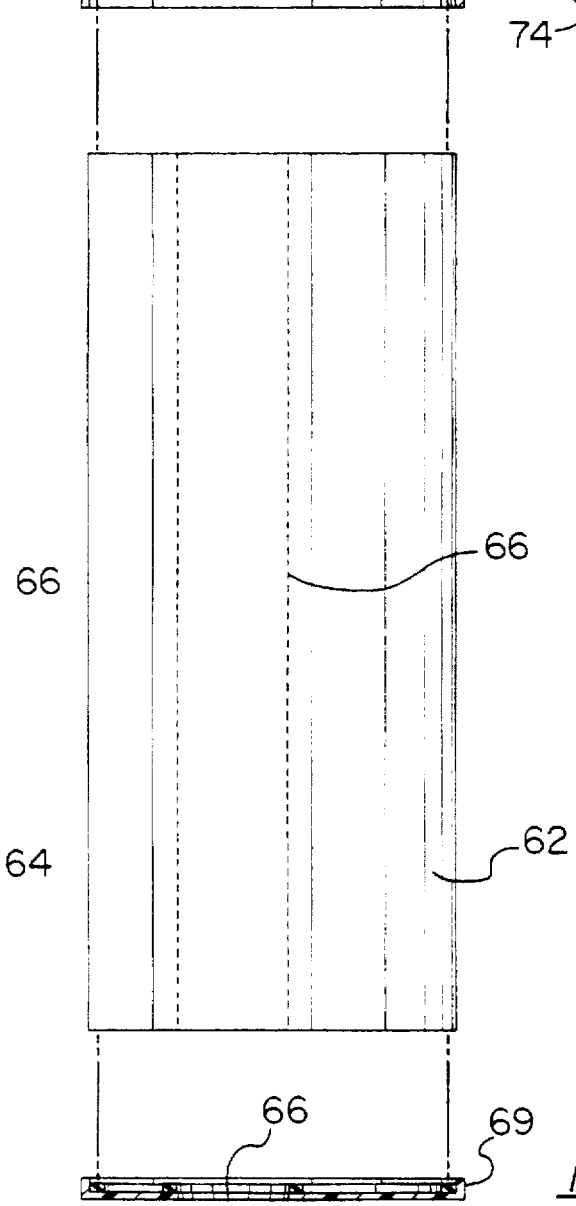
FIG. 6 is an exploded side view of the fluid container.

As shown in FIGS. 5 and 6, the fluid container 60 has a coaxially elongated passage 66. The fluid container 60 is for storing the viscous fluid. The fluid container 60 further is formed to fit within the lumen 22 and the elongated passage 66 slidably surrounds the center tube 29. A second aperture 74 projects into a top end of the fluid container 60. The blade 28 punctures the fluid container 60 and the pressure from the pumping means 30 enters the fluid container 60 through the second aperture 74 thereby forcing the viscous fluid into the first passage 21 then through the center tube 29 which thereafter projects through the threaded spout 50. The fluid container 60 has a first lid 68 and a second lid 69. The second lid 69 is removably secured to a bottom end of the fluid container 60 as shown in FIG. 6 of the drawings. The first lid 68 is removably secured to the fluid container 60 opposite of the second lid 68 as further shown in FIG. 6 of the drawings. The first aperture 72 projects into the first lid 68 for filling with the viscous fluid. The first aperture 72 is preferably enclosed by a removable cover 73 as best shown in FIG. 5 of the drawings. The second aperture 74 projects through the first lid 68 for receiving air pressure from the pumping means 30. Alternatively as shown in FIGS. 3 and 4, a hand pump 36 secured to the cylindrical container 20 is utilized instead of the flexible wall 32 and pump chamber 34. The fluid container 60 is constructed from a tubular pouch 62 with a swaged side 64 for positioning within the lumen 22 as shown in FIGS. 5 and 6.

As shown in FIGS. 1 through 4, a pumping means 30 is connected to an upper portion of the lumen 22 for pressurizing the lumen 22 for forcing the viscous fluid through the first passage 21 then into the center tube 29 and thereafter exiting through the threaded spout 50. The pumping means 30 has a second passage 23 through the base 26 from an exterior surface projecting into a pump chamber 34 within a flexible wall 32 of the cylindrical container 20. The flexible wall 32 is compressible by a user by squeezing the flexible wall 32 thereby increasing air pressure within the pump chamber 34. A first check valve 12 is within the second passage 23 allowing air to pass only into the pump chamber 34. A third passage 25 projects from the pump chamber 34 into the upper portion of the lumen 22. Air from the pump chamber 34 thereby pressurizes the lumen 22 and the fluid container 60. A second check valve 14 is positioned within the third passage 25 allowing air to pass only into the lumen 22.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A Viscous Fluid Dispensing System comprising:

a cylindrical container having a lumen;

a base secured to an end of said cylindrical container opposite of an open end;

a center tube coaxially projecting through said lumen to engage said base coaxially, where the end of said center tube opposite of said base is flush with said open end;

a first passage projecting from said lumen through said base and fluidly connecting to said center tube;

a threaded lid threadably engaging said open end;

an interior flange projects downwardly from said threaded lid to surround coaxially said center tube opposite of said base;

a flanged end tube having a threaded neck slidably positioned above said interior flange, where said threaded neck extends past said threaded lid a finite distance and wherein said flanged end tube is rotatable with respect to said center tube allowing rotation of a threaded spout;

a compression spring compressed mesial said flanged end tube and said threaded neck;

said threaded spout threadably secured to said threaded neck of said flanged end tube, for dispensing a viscous fluid within said lumen; and a pumping means connected to an upper portion of said lumen for pressurizing said lumen for forcing said viscous fluid through said first passage then into said center tube and exiting through said threaded spout.

2. The Viscous Fluid Dispensing System of claim 1, wherein:

a blade is secured to said base within said lumen and extends upwardly;

a fluid container having a cordially elongated passage for storing said viscous fluid, where said fluid container is formed to fit within said lumen and said elongated passage slidably surrounds said center tube; and a second aperture into a top end of said fluid container, where said blade punctures said fluid container and said pressure from said pumping means enters said fluid container through said second aperture forcing said viscous fluid into said first passage then through said center tube through said threaded spout.

3. The Viscous Fluid Dispensing System of claim 2, wherein said pumping means comprises:

a second passage through said base from an exterior surface projecting into a pump chamber within a flexible wall of said cylindrical container, where said flexible wall is compressible by a user by squeezing said flexible wall thereby increasing air pressure within said pump chamber;

a first check valve within said second passage allowing air to pass only into said pump chamber;

a third passage projecting from said pump chamber into said upper portion of said lumen, whereby air from said pump chamber pressurizes said lumen and said fluid container; and a second check valve within said third passage allowing air to pass only into said lumen.

4. The Viscous Fluid Dispensing System of claim 3, wherein said threaded spout has a cap pivotally attached for enclosing an exit passage connected to said flanged end tube, for preventing said viscous fluid from drying out.

5. The Viscous Fluid Dispensing System of claim 4, wherein said fluid container includes:

a first lid and a second lid, wherein said second lid is removably secured to a bottom end of said fluid container and said first lid is removably secured to said fluid container opposite of said second lid; and a first aperture into said first lid for filling with said viscous fluid, where said first aperture is enclosed by a removable cover.

6. The Viscous Fluid Dispensing System of claim 2, wherein said pumping means comprises:

a second passage through said base from an exterior surface projecting into a hand pump secured to said fluid container;

a first check valve within said second passage allowing air to pass only into said hand pump;

a third passage projecting from said hand pump opposite of said second passage into said upper portion of said lumen, whereby air pressure from said hand pump pressurizes said lumen and said fluid container; and a second check valve within said third passage allowing air to pass only into said lumen.

7. The Viscous Fluid Dispensing System of claim 6, wherein said threaded spout has a cap pivotally attached for enclosing an exit passage connected to said flanged end tube, for preventing said viscous fluid from drying out.

8. The Viscous Fluid Dispensing System of claim 7, wherein said fluid container includes:

a first lid and a second lid, wherein said second lid is removably secured to a bottom end of said fluid container and said first lid is removably secured to said fluid container opposite of said second lid;

a first aperture into said first lid for filling with said viscous fluid, where said first aperture is enclosed by a removable cover; and said second aperture projects into said first lid for receiving air pressure from said pumping means.

* * * * *